US008662501B1

(12) United States Patent
Perales

(10) Patent No.: US 8,662,501 B1
(45) Date of Patent: Mar. 4, 2014

(54) PORTABLE BEER PONG APPARATUS AND ASSOCIATED METHOD

(76) Inventor: Michael Perales, Pearland, TX (US)

( * ) Notice: Subject to any disclaimer, the term of this patent is extended or adjusted under 35 U.S.C. 154(b) by 225 days.

(21) Appl. No.: 13/358,509

(22) Filed: Jan. 25, 2012

Related U.S. Application Data

(60) Provisional application No. 61/435,825, filed on Jan. 25, 2011.

(51) Int. Cl.
*A63B 63/00* (2006.01)

(52) U.S. Cl.
USPC ..... 273/400; 224/482; 108/44; 108/46; 220/482

(58) Field of Classification Search
USPC ..... 273/398–402; 473/479; D21/303; 224/403, 404, 482; 206/217, 562; 108/44, 46, 47, 152; 248/214, 215, 248/311.2, 305; 220/480, 482, 737, 738, 220/751
See application file for complete search history.

(56) References Cited

U.S. PATENT DOCUMENTS

| | | | | | |
|---|---|---|---|---|---|
| 2,014,745 | A * | 9/1935 | Regli | 108/11 |
| 2,123,257 | A * | 7/1938 | Provost | 40/324 |
| 2,680,523 | A * | 6/1954 | Heeter | 108/44 |
| 2,744,752 | A * | 5/1956 | Arnold | 273/398 |
| 2,770,513 | A * | 11/1956 | Brown | 220/482 |
| 3,266,443 | A * | 8/1966 | Lee | 108/46 |
| 3,379,316 | A * | 4/1968 | Harrell | 211/73 |
| 4,030,760 | A * | 6/1977 | Danowski | 273/353 |
| 4,850,282 | A * | 7/1989 | Postic | 108/47 |
| 5,148,755 | A * | 9/1992 | Morales | 108/47 |
| 5,979,646 | A * | 11/1999 | Strachan | 206/217 |
| 5,996,507 | A * | 12/1999 | Joseph | 108/46 |
| 6,244,598 | B1 * | 6/2001 | Conville | 273/402 |
| 7,516,960 | B1 * | 4/2009 | Battiste | 273/342 |
| 7,562,787 | B2 * | 7/2009 | Serrano | 220/507 |
| 7,805,959 | B2 * | 10/2010 | Webb et al. | 62/457.3 |
| 7,845,644 | B2 * | 12/2010 | Constantine et al. | 273/317.6 |
| 2004/0226486 | A1 * | 11/2004 | Simpson | 108/47 |
| 2005/0029747 | A1 * | 2/2005 | Grayson | 273/342 |
| 2007/0063447 | A1 * | 3/2007 | Gholson et al. | 273/400 |
| 2009/0174234 | A1 * | 7/2009 | Vignal et al. | 297/163 |
| 2011/0215528 | A1 * | 9/2011 | Conville et al. | 273/402 |
| 2012/0085269 | A1 * | 4/2012 | Ohide | 108/44 |
| 2012/0169012 | A1 * | 7/2012 | Parker et al. | 273/400 |
| 2012/0256378 | A1 * | 10/2012 | Brown | 273/401 |

* cited by examiner

*Primary Examiner* — Mark Graham

(57) ABSTRACT

A portable beer pong table including a table having a plurality of coextensively shaped apertures formed therein, a plurality of flexible rings removably attached to the table and positioned about the apertures respectively, a plurality of rigid first support members attached to the table and spaced from the apertures, a plurality of rigid second support members attached to the first support members and extending downwardly from the table, a plurality of rigid third support members adjustably coupled to the second support members and disposed opposite to the first support members, and a plurality of anchoring sleeves positioned along a portion of the third support members and remaining spaced from the second support members respectively. In this manner, the second support members cooperate with the third support members to maintain the table at a substantially stable position.

15 Claims, 7 Drawing Sheets

PORTABLE BEER PONG APPARATUS AND ASSOCIATED METHOD

CROSS REFERENCE TO RELATED APPLICATIONS

This application claims the benefit of U.S. Provisional Application No. 61/435,825, filed Jan. 25, 2011, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE DISCLOSURE

1. Technical Field

This disclosure relates to drinking games and, more particularly, to a portable beer pong apparatus for providing users with an easy and convenient means of playing beer pong by utilizing their trucks to hold the beer pong tables.

2. Prior Art

Beer Pong (also known as Beirut) is a drinking game in which players throw a ping-pong ball across a table with the intent of landing the ball in a cup of beer on the other end. The game typically consists of two two-player teams and multiple cups set up on each side set up in triangle formation. There are no official rules, so rules may vary widely, though usually there are six or ten plastic cups arranged in a triangle on each side. The goal of the game is to eliminate the other teams' cups before one's own cups are eliminated. When a ball lands in a cup, which are generally ¼ to ⅓ full, that cup is eliminated and the defending team must consume all of the beer inside that cup. The losing team must consume all the beer remaining in the winning team's cups. The order of play varies—both players on one team shoot followed by both players on the other team or players on opposite teams can alternate back and forth. Today, beer pong is played at parties, North American colleges and universities and elsewhere, such as tailgating or other sporting events. The game is also played by high school students, despite the fact that supplying alcohol to persons in these ages is sometimes and in some places illegal.

Although the game is typically played on either a ping pong table or a folding banquet table, enthusiasts may create a personalized table for use by friends and visitors. In general, this will be a plywood board cut to proper size, sometimes painted with sports, school, or fraternity symbols and given a liquid-proof coating. Some companies sell tables as well. Usually these tables are set up on flat even ground or concrete floors which may allow the tables to be laid in a relatively horizontal orientation to ensure that the cups of beer are not tilted and therefore easily toppled and spilled. The set-up in these occasions therefore requires flat surfaces and unfortunately may not be adequately set up in places with uneven surfaces such as on beaches or even picnic grounds. The bulky tables also make them difficult to transport and thus many enthusiasts may miss the fun of a beer pong game at beach parties and picnics where serious fun with beer is the norm.

Accordingly, a need remains for portable beer pong apparatus in order to overcome the above-noted shortcomings. The present disclosure satisfies such a need by providing a portable beer pong apparatus that is convenient and easy to use, lightweight yet durable in design, versatile in its applications, and designed for playing beer pong by utilizing trucks to hold the beer pong tables.

BRIEF SUMMARY OF THE DISCLOSURE

In view of the foregoing background, it is therefore an object of the non-limiting exemplary embodiments to provide a portable beer pong table that can be used in a variety of environments including a bed of a truck, for example. These and other objects, features, and advantages of the disclosure are provided by a portable beer pong table including a table having a plurality of coextensively shaped apertures formed therein, a plurality of flexible rings removably attached to the table and positioned about the apertures respectively, a plurality of rigid first support members attached to the table and spaced from the apertures, a plurality of rigid second support members attached to the first support members and extending downwardly from the table, a plurality of rigid third support members adjustably coupled to the second support members and disposed opposite to the first support members, and a plurality of anchoring sleeves positioned along a portion of the third support members and remaining spaced from the second support members respectively. In this manner, the second support members cooperate with the third support members to maintain the table at a substantially stable position.

In a non-limiting exemplary embodiment, the table has a planar top surface and further has a plurality of linear sleeves juxtaposed along non-conjoined edges of the planar top surface.

In a non-limiting exemplary embodiment, the first support members may include a plurality of linear rods removably interfitted within the linear sleeves, and a plurality of arcuate couplings connecting the linear rods in a substantially U-shaped configuration.

In a non-limiting exemplary embodiment, each of the second support members may include a plurality of guide orifices aligned with the linear sleeves. Notably, a portion of the first and third support members pass through guide orifices prior to entering the linear sleeves respectively.

In a non-limiting exemplary embodiment, each of the second support members may further include an elbow and a protective sleeve positioned thereabout.

In a non-limiting exemplary embodiment, each of the third support members may include a fastener removably engaged with selected ones of the guide orifices in such a manner that the third support members are selectively rotatable about mutually exclusive fulcrum axes aligned with opposed ones of the linear sleeves respectively.

In a non-limiting exemplary embodiment, each of the third support members is L-shaped.

The present disclosure further includes a method of utilizing a portable beer pong table. Such a method preferably includes the chronological steps of: providing a table having a plurality of coextensively shaped apertures formed therein; providing and removably attaching a plurality of flexible rings to the table; positioning the rings about the apertures respectively; providing and attaching a plurality of rigid first support members to the table; spacing the first support members from the apertures; providing and attaching a plurality of rigid second support members to the first support members; and downwardly extending the second support members from the table.

The method further includes the chronological steps of: providing and adjustably coupling a plurality of rigid third support members to the second support members; oppositely disposing the third support members to the first support members; providing and positioning a plurality of anchoring sleeves along a portion of the third support members; and maintaining the anchoring sleeves spaced from the second support members respectively. In this manner, the second support members cooperate with the third support members to maintain the table at a substantially stable position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the disclosure of the application, which is measured by the claims, nor is it intended to be limiting as to the scope of the disclosure in any way.

BRIEF DESCRIPTION OF THE SEVERAL VIEWS OF THE DRAWING

The novel features believed to be characteristic of this disclosure are set forth with particularity in the appended claims. The disclosure itself, however, both as to its organization and method of operation, together with further objects and advantages thereof, may best be understood by reference to the following description taken in connection with the accompanying drawings in which:

Figure 1:
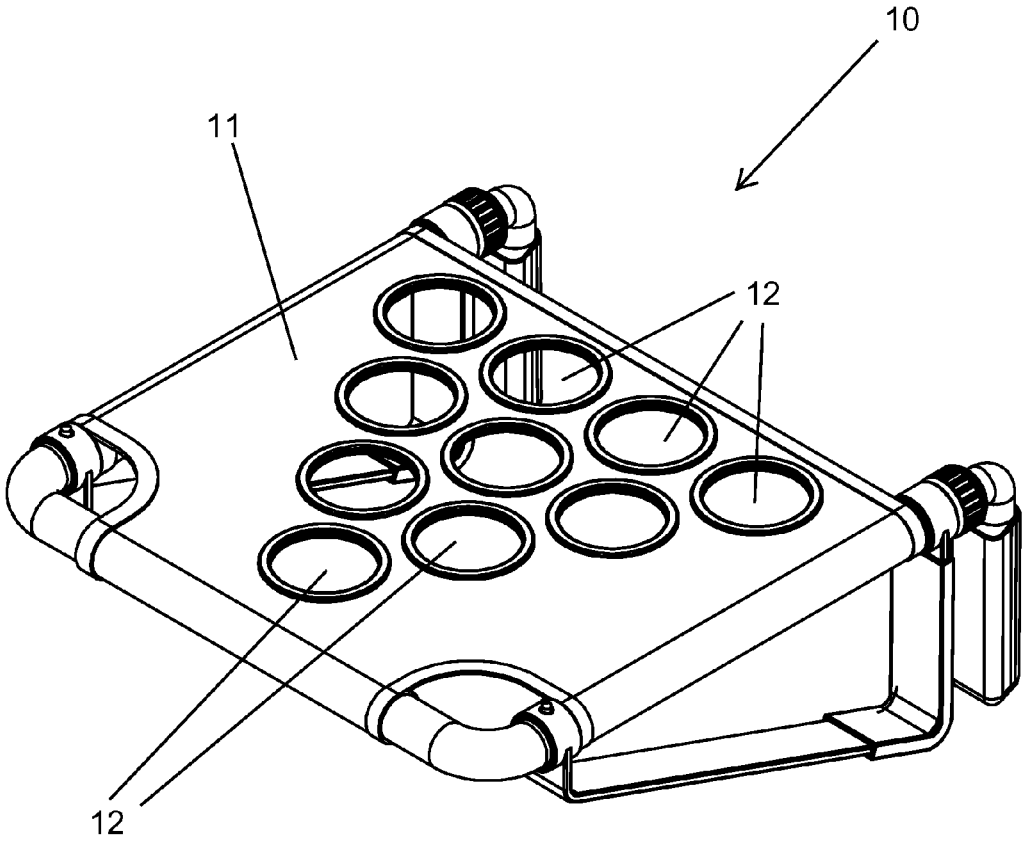
FIG. 1 is a perspective view showing a portable bear pong table, in accordance with a non-limiting exemplary embodiment of the present disclosure.
Figure 2:
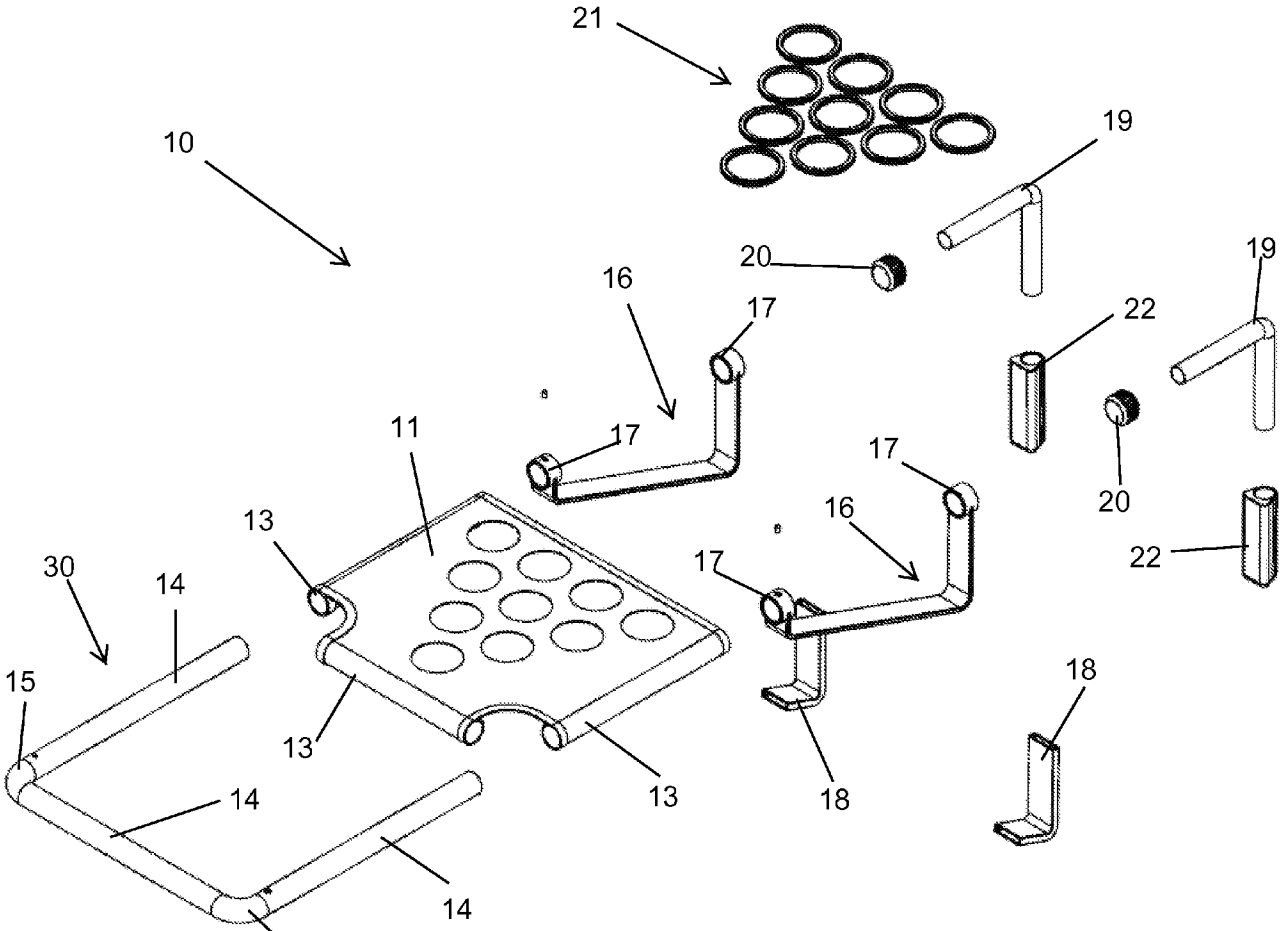
FIG. 2 is an exploded view of the beer pong table shown in FIG. 1.
Figure 3:
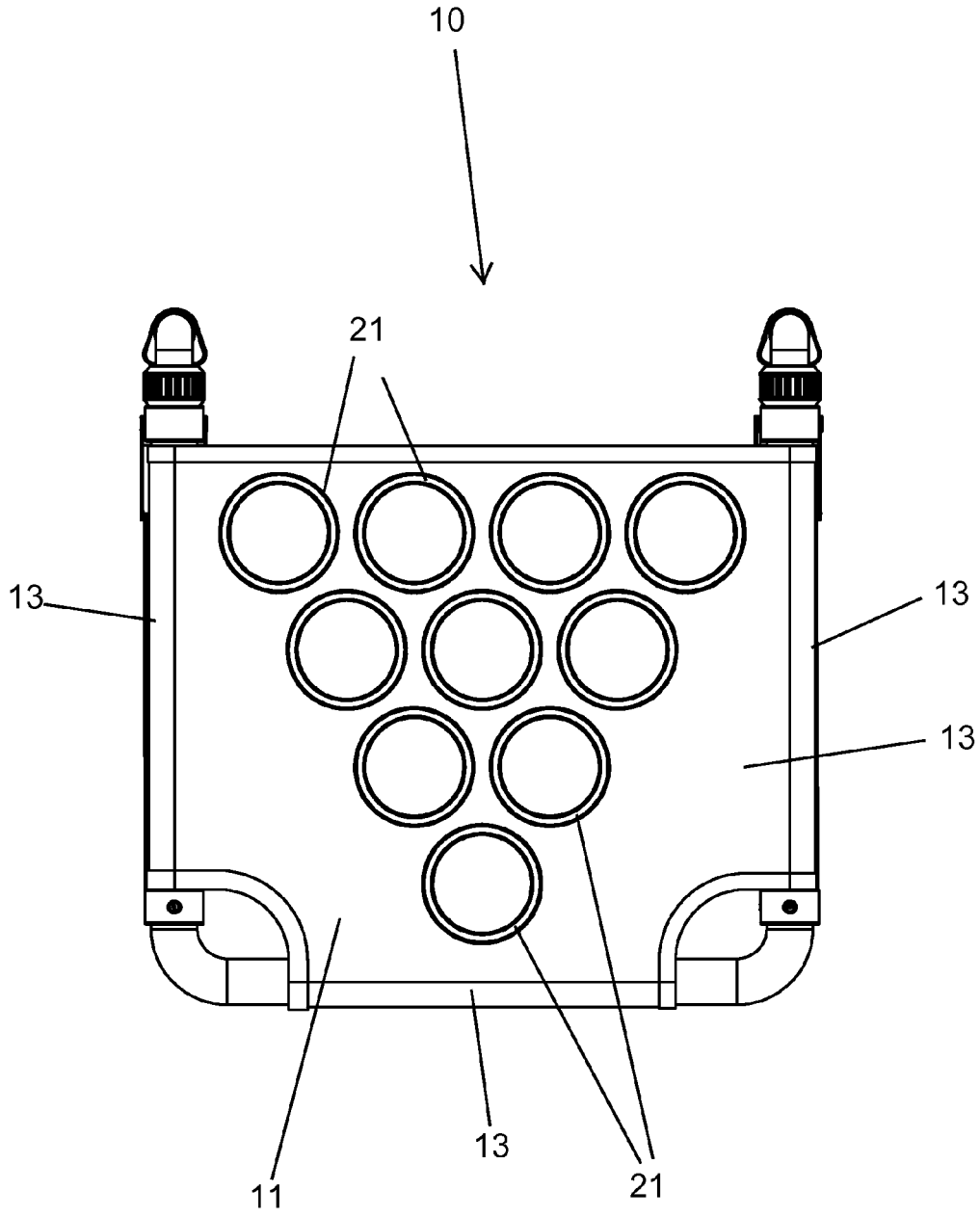
FIG. 3 is a top plan view of the beer pong table shown in FIG. 1.
Figure 4:
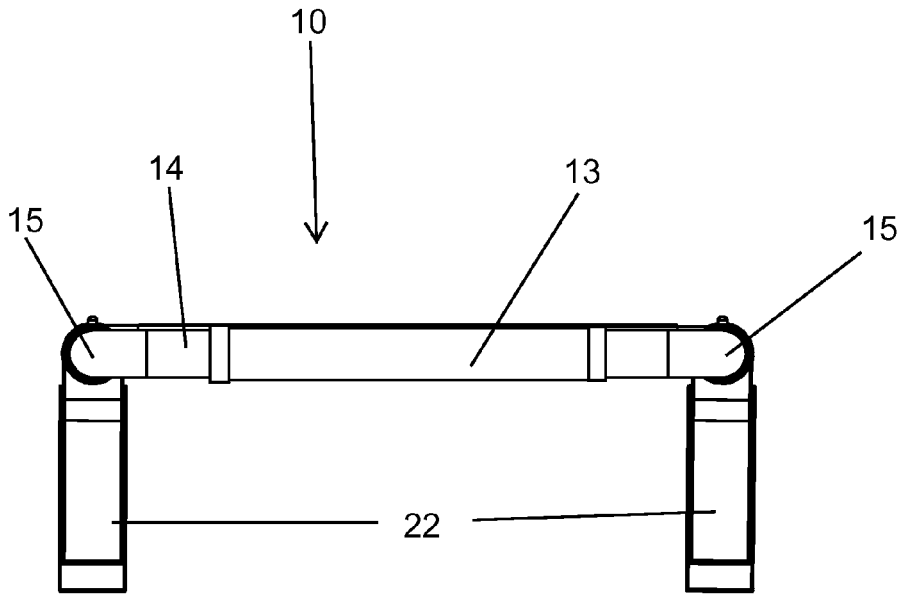
FIG. 4 is top plan view of the beer pong table shown in FIG. 1.
Figure 5A:
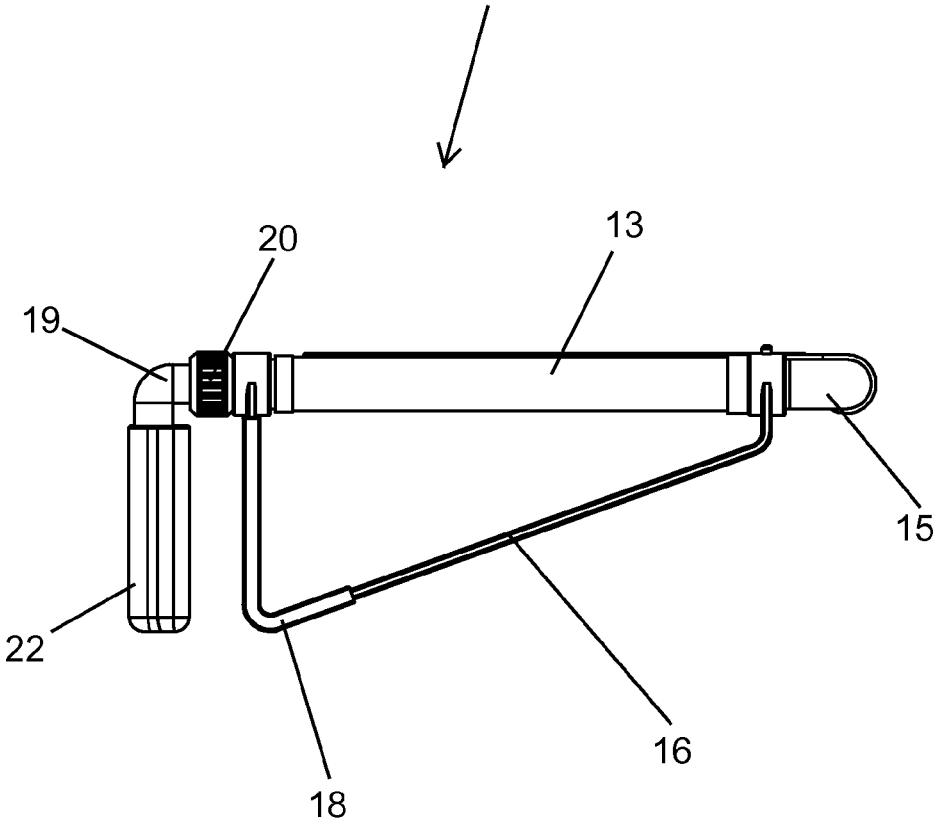
FIGS. 5*a-b* are side elevational views of the beer pong table disposed at retracted and extended positions, respectively.
Figure 5B:
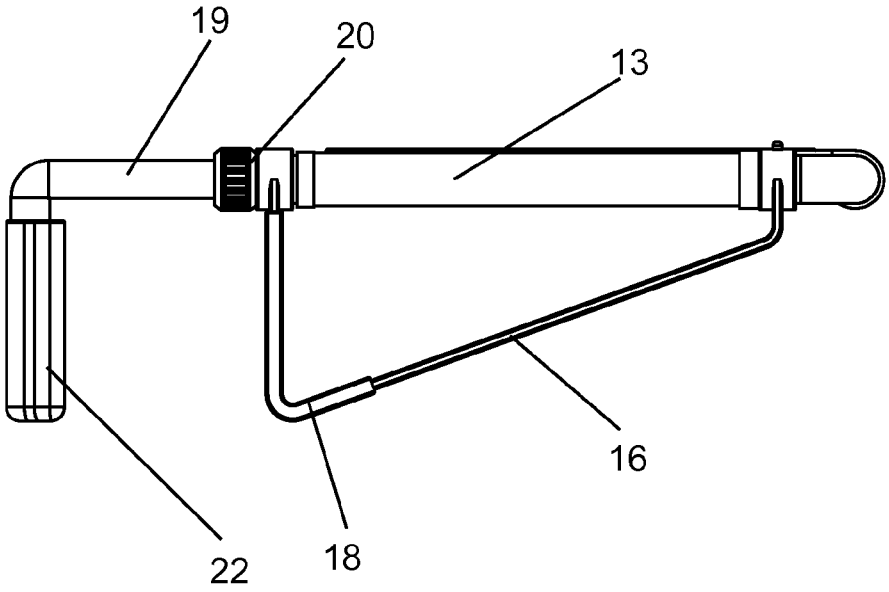

Those skilled in the art will appreciate that the figures are not intended to be drawn to any particular scale; nor are the figures intended to illustrate every embodiment of the disclosure. The disclosure is not limited to the exemplary embodiments depicted in the figures or the shapes, relative sizes or proportions shown in the figures.

DETAILED DESCRIPTION OF THE DISCLOSURE

The non-limiting exemplary embodiments will now be described more fully hereinafter with reference to the accompanying drawings, in which a preferred embodiment of the disclosure is shown. This disclosure may, however, be embodied in many different forms and should not be construed as limited to the embodiment set forth herein. Rather, this embodiment is provided so that this application will be thorough and complete, and will fully convey the true scope of the disclosure to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "non-limiting exemplary embodiments" merely for convenience and without intending to voluntarily limit the scope of this application to any particular disclosure or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the non-limiting exemplary embodiments. Thus, to the maximum extent allowed by law, the scope of the non-limiting exemplary embodiments is to be determined by the broadest permissible interpretation of the following claims and their equivalents, and shall not be restricted or limited by the foregoing

DETAILED DESCRIPTION

References in the specification to "one embodiment", "an embodiment", "a preferred embodiment", "an alternative embodiment" and similar phrases mean that a particular feature, structure, or characteristic described in connection with the embodiment is included in at least an embodiment of the disclosure. The appearances of the phrase "non-limiting exemplary embodiment" in various places in the specification are not necessarily all meant to refer to the same embodiment.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

In the drawings, like numerals indicate like elements throughout. Certain terminology is used herein for convenience only and is not to be taken as a limitation on the present disclosure. The terminology includes the words specifically mentioned, derivatives thereof and words of similar import. The embodiments illustrated below are not intended to be exhaustive or to limit the disclosure to the precise form disclosed. These embodiments are chosen and described to best explain the principle of the disclosure and its application and practical use and to enable others skilled in the art to best utilize the disclosure.

The apparatus of this disclosure is referred to generally in FIGS. 1-6 and is intended to provide a truck attachable beer pong table 10. It should be understood that the present embodiment may be used to play beer pong at the bed of a truck and other types of similar structures to hold the beer pong tables, and should not be limited to the uses described herein.

Referring to FIGS. 1-6, a portable beer pong table 11, hereinafter apparatus 10, according to a non-limiting exemplary embodiment of the present disclosure is shown. The apparatus 10 can be used in a variety of environments including a bed of a truck, for example. Such an apparatus 10 includes a table 11 having a plurality of coextensively shaped apertures 12 formed therein. Preferably, table 11 extends at least one foot in width and/or length. However, one skilled in the art will recognized that table 11 may be formed in a variety of dimensions. Table 11 may be formed from a noncorrosive material that will not be destroyed or irreversibly damaged by liquid contact. For example, table 11 may be constructed of materials similar to but not limited to plastic, vinyl, cloth, and polyester. The noncorrosive quality of table 11 is preferred for easily cleaning liquid and debris therefrom. For example, after use, one may disassemble and wipe down apparatus 10 with a sponge, or towel and then stow away.

In a non-limiting exemplary embodiment, table 11 may be decorated with artwork to enhance enjoyment of playing a beer pong game and to indicate the team of the participating members. For example, table 11 may include surface indicia imprinted thereon; a team logo, sport, fraternity, flag, etc.

Apparatus 10 further includes a plurality of flexible rings 21 removably attached to table 11 and positioned about apertures 12, respectively. Rings 21 may be removed after use for cleaning, and applying new design configurations on table 11. For example, a user may coordinate rings 21 of different color and designs and insert them into the apertures 12 to customize the appearance of apparatus 10.

Apparatus 10 further includes a plurality of rigid first support members 30 attached to table 11 and spaced from apertures 12, a plurality of rigid second support members 16 attached to first support members 30 and extending downwardly from table 11, a plurality of rigid third support members 19 adjustably coupled to the second support members 16 and disposed opposite to first support members 30, and a plurality of anchoring sleeves 22 positioned along a portion of third support members 19 and remaining spaced from second support members 16, respectively. In this manner, second support members 16 cooperate with the third support members 19 to maintain table 11 at a substantially stable position during use.

In a non-limiting exemplary embodiment, anchoring sleeves 22 preferably possess a high coefficient of friction for ensuring apparatus 10 does not prematurely or undesirably shift during use.

In a non-limiting exemplary embodiment, table 11 has a planar top surface and further has a plurality of linear sleeves 13 juxtaposed along non-conjoined edges of the planar top surface.

In a non-limiting exemplary embodiment, first support members 30 may include a plurality of linear rods 14 removably interfitted within linear sleeves 13, and a plurality of arcuate couplings 15 connecting linear rods 14 in a substantially U-shaped configuration.

In a non-limiting exemplary embodiment, each second support member 16 may include a plurality of guide orifices 17 aligned with linear sleeves 13. Notably, a portion of the first and third support members 30, 19 pass through guide orifices 17 prior to entering the linear sleeves 13, respectively.

In a non-limiting exemplary embodiment, each second support member 16 may further include an elbow and a protective sleeve 18 positioned thereabout.

Figure 6:
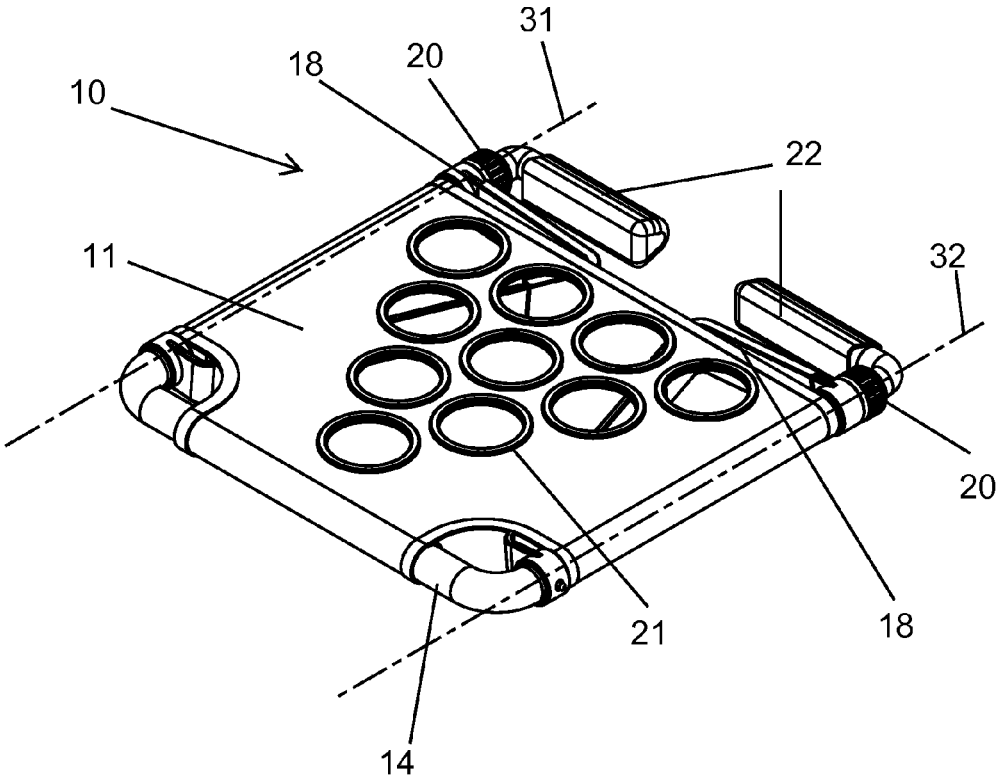
FIG. 6 is a perspective view of the beer pong table rotated to a stowed position.

In a non-limiting exemplary embodiment, each third support member 19 may include a fastener 20 removably engaged with selected ones of the guide orifices 17 in such a manner that third support members 19 are selectively rotatable about mutually exclusive fulcrum axes 31, 32 aligned with opposed ones of linear sleeves 13, respectively (as perhaps best shown in FIG. 6). Thus apparatus 10 may be deployed from a stowed position.

In a non-limiting exemplary embodiment, each third support member 19 is L-shaped, which is critical for ensuring anchoring sleeves 22 maintain proper frictional contact with a support surface while table 11 is registered along a desired plane (i.e., horizontal plane).

The present disclosure further includes a method of utilizing a portable beer pong table 11. Such a method preferably includes the chronological steps of: providing a table 11 having a plurality of coextensively shaped apertures 12 formed therein; providing and removably attaching a plurality of flexible rings 21 to table 11; positioning rings 21 about apertures 12 respectively; providing and attaching a plurality of rigid first support members 30 to table 11; spacing first support members 30 from apertures 12; providing and attaching a plurality of rigid second support members 16 to first support members 30; and downwardly extending second support members 16 from table 11.

The method further includes the chronological steps of: providing and adjustably coupling a plurality of rigid third support members 19 to second support members 16; oppositely disposing third support members 19 to first support members 30; providing and positioning a plurality of anchoring sleeves 22 along a portion of third support members 19; and maintaining anchoring sleeves 22 spaced from second support members 16, respectively. In this manner, second support members 16 cooperate with third support members 19 to maintain table 11 at a substantially stable position.

In a non-limiting exemplary embodiment, a user may insert a plurality of cups filled with a beverage of choice, into apertures 12 without risk of toppling the cups when struck by a ping pong ball. Each table 11 may hold, for example, ten beverage cups arranged in a triangular format. Two tables 11 may face each other to allow two teams of players to play a game of beer pong.

In a non-limiting exemplary embodiment, table 11 may further include a plurality of suction cups and/or sticky pads located at rings 12 for providing additional support to cups.

In use, the portable beer pong apparatus 10 would be simple and straightforward to use. First, the user may secure two tables 11 at opposite sides of a truck. He may then place a plurality of cups in apertures 12. He may then divide players into two teams, for example Team A and Team B. In play, each team may toss ping pong balls into cups on opposite sides of the truck. At the end of the game, the user may disengage tables 11 from the truck, pack them into a carry bag, place the bag in the back of his truck and he is ready to drive home in fractions of time taken to dismantle a conventional beer pong table.

While the disclosure has been described with respect to a certain specific embodiment, it will be appreciated that many modifications and changes may be made by those skilled in the art without departing from the spirit of the disclosure. It is intended, therefore, by the appended claims to cover all such modifications and changes as fall within the true spirit and scope of the disclosure. In particular, with respect to the above description, it is to be realized that the optimum dimensional relationships for the parts of the non-limiting exemplary embodiments may include variations in size, materials, shape, form, function and manner of operation.

What is claimed as new and what is desired to secure by Letters Patent of the United States is:

1. A portable beer pong table comprising:

a table having a plurality of apertures formed therein;

a plurality of rings removably attached to said table and positioned about said apertures respectively;

a plurality of first support members attached to said table and spaced from said apertures;

a plurality of second support members attached to said first support members and extending downwardly from said table;

a plurality of third support members adjustably coupled to said second support members and disposed opposite to said first support members; and a plurality of anchoring sleeves positioned along a portion of said third support members and remaining spaced from said second support members respectively;

wherein said second support members cooperate with said third support members to maintain said table at a substantially stable position.

2. The portable beer pong table of claim 1, wherein said table has a planar top surface and further has a plurality of linear sleeves juxtaposed along non-conjoined edges of said planar top surface.

3. The portable beer pong table of claim 2, wherein said first support members comprise:

a plurality of linear rods removably interfitted within said linear sleeves; and a plurality of arcuate couplings connecting said linear rods in a substantially U-shaped configuration.

4. The portable beer pong table of claim 3, wherein each of said second support members comprise: a plurality of guide orifices aligned with said linear sleeves, wherein a portion of said first and third support members are passed through guide orifices prior to entering said linear sleeves respectively.

5. The portable beer pong table of claim 1, wherein each of said second support members further comprises: an elbow and a protective sleeve positioned thereabout.

6. The portable beer pong table of claim 4, wherein each of said third support members comprises:

a fastener removably engaged with selected ones of said guide orifices in such a manner that said third support members are selectively rotatable about mutually exclusive fulcrum axes aligned with opposed ones of said linear sleeves respectively.

7. The portable beer pong table of claim 1, wherein each of said third support members is L-shaped.

8. A portable beer pong table comprising:

a table having a plurality of coextensively shaped apertures formed therein;

a plurality of flexible rings removably attached to said table and positioned about said apertures respectively;

a plurality of rigid first support members attached to said table and spaced from said apertures;

a plurality of rigid second support members attached to said first support members and extending downwardly from said table;

a plurality of rigid third support members adjustably coupled to said second support members and disposed opposite to said first support members; and a plurality of anchoring sleeves positioned along a portion of said third support members and remaining spaced from said second support members respectively;

wherein said second support members cooperate with said third support members to maintain said table at a substantially stable position.

9. The portable beer pong table of claim 8, wherein said table has a planar top surface and further has a plurality of linear sleeves juxtaposed along non-conjoined edges of said planar top surface.

10. The portable beer pong table of claim 9, wherein said first support members comprise:

a plurality of linear rods removably interfitted within said linear sleeves; and a plurality of arcuate couplings connecting said linear rods in a substantially U-shaped configuration.

11. The portable beer pong table of claim 10, wherein each of said second support members comprise: a plurality of guide orifices aligned with said linear sleeves, wherein a portion of said first and third support members are passed through guide orifices prior to entering said linear sleeves respectively.

12. The portable beer pong table of claim 8, wherein each of said second support members further comprises: an elbow and a protective sleeve positioned thereabout.

13. The portable beer pong table of claim 11, wherein each of said third support members comprises:

a fastener removably engaged with selected ones of said guide orifices in such a manner that said third support members are selectively rotatable about mutually exclusive fulcrum axes aligned with opposed ones of said linear sleeves respectively.

14. The portable beer pong table of claim 8, wherein each of said third support members is L-shaped.

15. A method of utilizing a portable beer pong table, said method comprising the chronological steps of:

providing a table having a plurality of coextensively shaped apertures formed therein;

providing and removably attaching a plurality of flexible rings to said table;

positioning said rings about said apertures respectively;

providing and attaching a plurality of rigid first support members to said table;

spacing said first support members from said apertures;

providing and attaching a plurality of rigid second support members to said first support members;

downwardly extending said second support members from said table;

providing and adjustably coupling a plurality of rigid third support members to said second support members;

oppositely disposing said third support members to said first support members;

providing and positioning a plurality of anchoring sleeves along a portion of said third support members; and maintaining said anchoring sleeves spaced from said second support members respectively;

wherein said second support members cooperate with said third support members to maintain said table at a substantially stable position.

* * * * *